United States Patent [19]

Lanzani

[11] Patent Number: 4,856,712

[45] Date of Patent: Aug. 15, 1989

[54] WATERSPRAY DEVICE FOR ICE MAKING MACHINES

[75] Inventor: Emanuele Lanzani, Milan, Italy

[73] Assignee: King-Seeley Thermos Co., Prospect Heights, Ill.

[21] Appl. No.: 172,020

[22] Filed: Mar. 23, 1988

[30] Foreign Application Priority Data

Apr. 7, 1987 [IT] Italy ..... 20006A/87

[51] Int. Cl.[4] ..... F23D 11/38

[52] U.S. Cl. ..... 239/106; 62/347; 239/251; 239/468

[58] Field of Search ..... 62/347; 239/106, 246, 239/251, 491, 492, 468

[56] References Cited

U.S. PATENT DOCUMENTS

| | | | |
|---|---|---|---|
| 911,717 | 2/1909 | Gibbs | 239/251 |
| 1,180,526 | 4/1916 | Partridge | 239/251 X |
| 1,363,703 | 12/1920 | Zimmermann | 239/492 |
| 2,960,990 | 11/1960 | Jones et al. | 239/251 X |
| 3,253,784 | 5/1966 | Long et al. | 239/251 X |
| 3,342,421 | 9/1967 | Schutte | 239/246 X |
| 3,550,859 | 12/1970 | Pettit | 239/491 X |
| 3,642,207 | 2/1972 | Kragman | 239/251 |
| 3,791,163 | 2/1974 | Dickson et al. | 62/347 |
| 4,418,868 | 12/1983 | Gurubatham et al. | 239/251 X |

*Primary Examiner*—William E. Tapopcai

*Attorney, Agent, or Firm*—Abelman Frayne Rezac & Schwab

[57] ABSTRACT

This invention relates to a device for the delivery of a fluid to be frozen in equipment for the formation of ice cubes, which includes a rod spraying the fluid on an evaporator and drive means for rotating the rod which are activated by the same fluid to be frozen.

3 Claims, 2 Drawing Sheets

WATERSPRAY DEVICE FOR ICE MAKING MACHINES

DESCRIPTION

This invention relates to a device for the delivery of a fluid to be frozen in equipment for the formation of ice cubes.

As it is known, the equipment available on the market for the production of ice cubes is a device generally delivering water against an evaporator to freeze it thus making the ice cubes.

The above-mentioned device is generally provided with a water spraying rod that is rotated by means of a gearmotor through a motion transmission fork.

Even if such devices successfully solve the problems related to the production of ice cubes, they usually involve a more complex apparatus combined with higher costs to produce the same and, consequently, with higher sales price.

Furthermore, from what has been said, it clearly results that the well-known equipment so structured is characterized by a higher energy consumption and a very high maintenance cost as well as by harmful scale formation inside the spraying rod and on the nozzles delivering the fluid to be frozen.

The object of this invention is to overcome the drawbacks mentioned above by making a device for the delivery of a fluid to be frozen in equipment for the formation of ice cubes, which does not need any additional members designed to rotate the spraying rod. Within this scope, an important object of the invention is to design a device for the delivery of a fluid to be frozen that is extremely simple and cheap so that its application in an apparatus for the production of ice cubes makes the same extremely cheap so to make its spreading on the market easier.

Another object of the invention is to make a device for the delivery of a fluid to be frozen that is easy to be maintained and is characterized by an extremely reliable operation.

Another object of the invention is to design a device for the delivery of a fluid to be frozen that is free from harmful effects caused by scale formations within its spraying rod.

These and other objects are fulfilled by a device for the delivery of a fluid to be frozen in equipment for the formation of ice cubes including a rod spraying the fluid on an evaporator, characerized in that it includes fluid-dynamic drive means for driving said rod activated by said fluid to be frozen.

Other characteristics and advantages of the invention will be better understood from the description of a preferred embodiment, but not limited thereto, of the device in accordance with the invention, as shown, by way of example, in the enclosed drawings in which.

Figure 1:
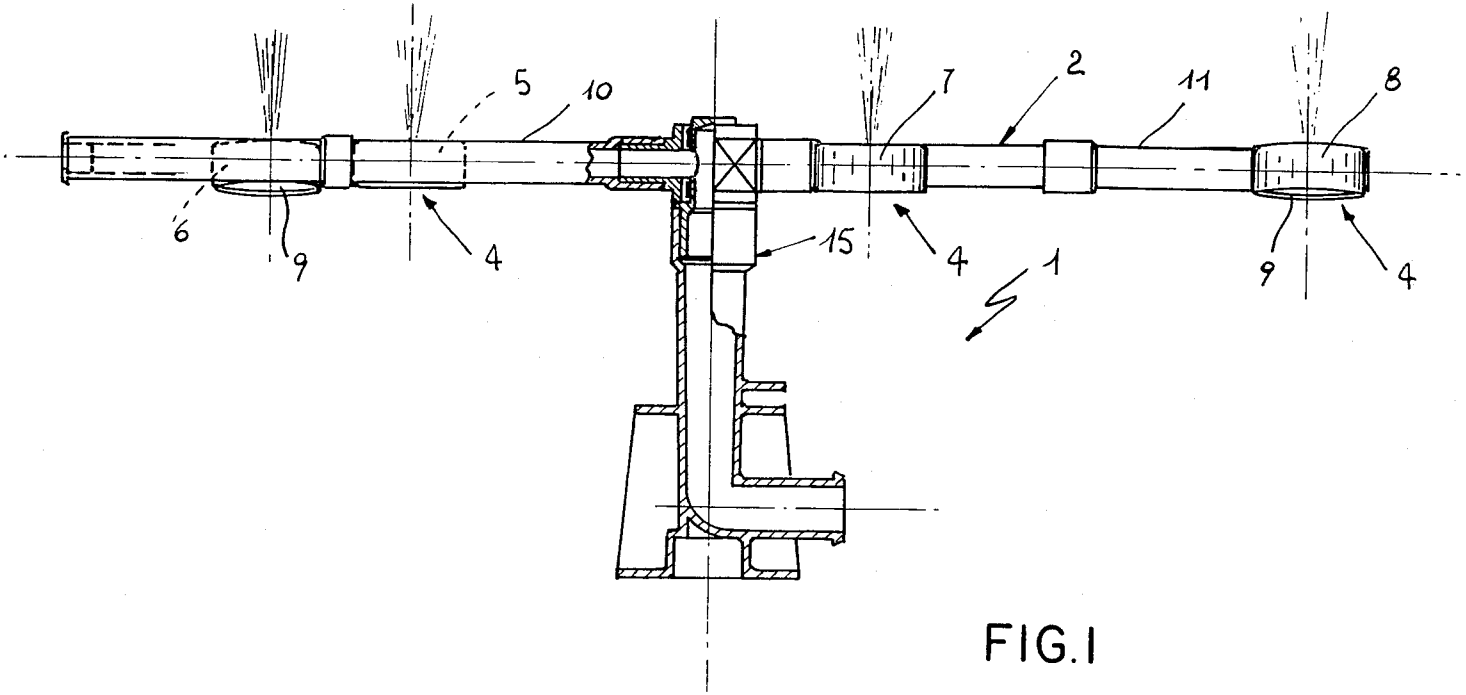
FIG. 1 is a side elevation view of the spraying rod in accordance with the invention.
Figure 2:
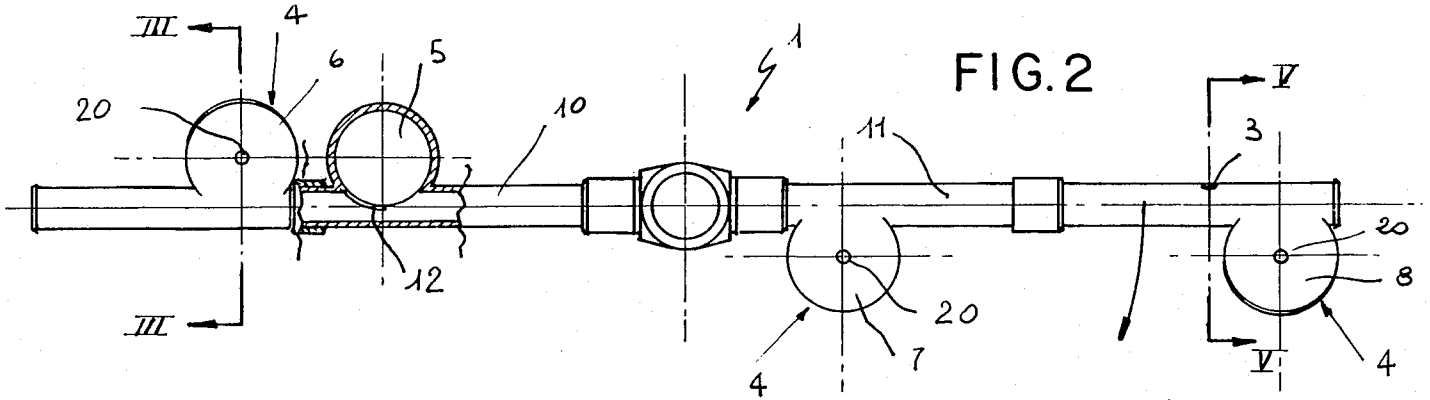
FIG. 2 is a plan view of the spraying rod in accordance with the invention.
Figure 5:
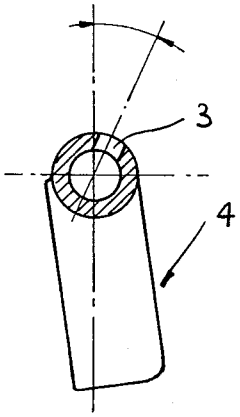
FIG. 5 is a view along the V—V section line of FIG. 2 in accordance with the invention.
Figure 4:
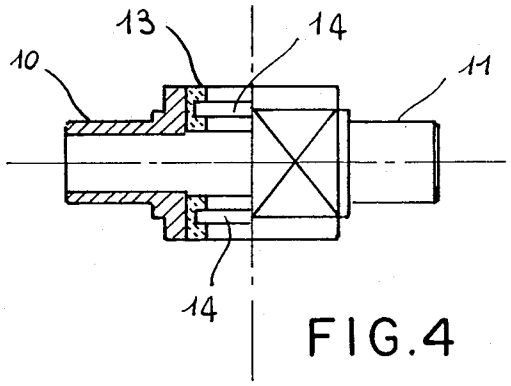
FIG. 4 shows the enlarged detail of the central portion of the spraying rod illustrated in FIG. 1 in accordance with the invention.
Figure 3:
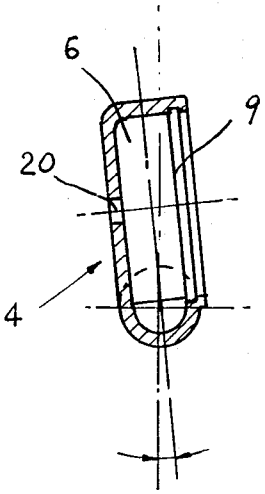
FIG. 3 is a view along the III—III section line of FIG. 2 in accordance with the invention.

With particular reference to the above-mentioned figures, the device for the delivery of a fluid to be frozen is indicated generally at one includes a rod indicated generally at 2, spraying a fluid and more precisely drinking water below an evaporator of a well-known type and not shown in the drawings.

The spraying rod has drive means and more precisely an opening 3 as it will be better specified hereinafter. On the rod 2 there are also spray nozzles, each indicated generally at 4, to spray the fluid on the evaporator, that is not shown in the figure as already said, which have a chamber each, that is generally referred to as 5, being associated to the rod and communicating with its internal portion.

Suitably the chambers 5 vary their inclination, relatively to the rotation plane of the spraying rod, in relation to their distance from the axis of rotation of the same.

The difference in the inclination of the chambers 5 is determined by the fact that, according to their distance from the axis of rotation, their angular velocity varies together with that of the spraying rod and, therefore, it is necessary that the spray exiting the holes 20 be inclined at a greater angle towards the rod end and inclined at a smaller angle close to the axis of rotation of the spraying rod, so that the spray can hit by a right angle against the evaporator which, otherwise, would not be influenced in the best way by the fluid spray.

More precisely, the chambers 5, 6 7 and 8 have a substantially cylindrical configuration. The hole 20 faces towards the evaporator while, on the opposite side of said hole, the chambers have a closure disc 9, that is advantageously removable, to allow their internal inspection and the removal of any scale or other debris that has collected within them.

The sum of the distances of a first pair of chambers from the axis of rotation of the spraying rod, for example the sum of the distances of chambers 5 and 6 associated with a first arm 10 of the same, is equal to the sum of the distances, of the second pair of chambers 7 and 8 associated to the second arm 11 from the axis of rotation of the spraying rod.

In order that the fluid passing inside the two arms 10 and 11 enters easily and in a sufficient amount into each self-cleaning chamber, the latter each have a deflector 12 that extends into the two arms 10 or 11 substantially up to the horizontal axis of the spraying rod.

As already mentioned, rotation of the spraying rod is provided by the opening 3 having a diameter equal to the diameter of the holes 20.

The distance of the opening 3 from the axis of rotation of the spraying rod depends on the diameter of the opening 3, and, on the pressure at which the fluid is introduced in the spraying rod.

Moreover, the opening 3 has an inclination relatively to the rod rotational plane so that the component of the propulsion force guarantees to the rod an ideal speed of rotation according to the required needs.

Furthermore, the spraying rod has two opposing bushings 13 co-axially to its axis of rotation, which provide seats 14 each being designed to hold a seal for the hydraulic seal of a support bearing indicated generally at 15.

The operation of the device in accordance with the invention is evident from what has been described and illustrated herein, in particular with reference to the Figures it is possible to notice that the fluid, in this case drinking water, is supplied, at a given pressure, through a pump well-known on itself, inside the supporting element 15 and from this into the spraying rod 2.

Thanks to the existence of portions 12 developing inside the first and the second arm of the spraying rod, the fluid enters each self-cleaning chamber, with a vortex motion, it comes out of the hole 20 to hit the evaporator located over the spraying rod.

As already mentioned, thanks to the special location of the self-cleaning chambers on the spraying rod, the latter will In practice, it was observed that the device according to the invention is extremely advantageous to allow the spraying rod to be driven without using for this reason any additional member such as, for example, a gearmotor or a fork for motion transmission. The fluid penetrating the spraying rod and designed to create the sprays, provokes by means of the opening 3 the rotation of the same around its fulcrum axis.

The invention as conceived herein is subject to many modifications with variants all falling within the principle of the invention; furthermore, all details can be replaced by technically equivalent elements.

In practice, the materials used as well as the size can be of any type according to the needs and to the state of the art.

I claim:

1. Apparatus for the delivery of a water spray to an ice cube making machine, comprising:

a hollow tubular spray arm having a longitudinal axis;

a support bearing for said spray arm permitting rotation of said spray in a horizontal plane about a vertical axis bisecting the said longitudinal axis of said spray arm, said support bearing providing for the supply of water under pressure to the interior of said spray arm;

water reception chambers mounted externally on said tubular spray arm at selected distances spaced from said vertical axis, each said water receptive chamber being comprised of a hollow cylindrical wall portion arranged with a longitudinal axis thereof at an angle to said vertical axis, and with said hollow cylindrical wall portion intersecting said hollow tubular spray arm at a tangent to said hollow cylindrical wall portion and communicating with the interior of said hollow tubular spray arm to provide a vortex flow of water within each said water receptive chamber;

end closure members closing the respective ends of each said hollow cylindrical wall portion, an uppermost end wall of each said water receptive chamber including spray means for directing a spray of water in an upward direction, a lower most one of said end closure members being manually removable to permit the removal of debris from the associated water reception chamber; and a jet for water in communication with the interior of said spray arm and providing propulsive power for rotating said arm about said vertical axis;

whereby, debris or particulate matter entrained in said supply of water is separated by centrifugal action from said water supply within said water reception chambers and is retained within said water reception chambers for subsequent removal therefrom by removal of said lowermost end closure members of said water reception chambers.

2. The apparatus of claim 1, in which the longitudinal axis of selected ones of said water receptive chambers is inclined relative to said vertical axis.

3. The apparatus of claim 1, including a deflector member associated with each said water receptive chamber and extending into the interior of said hollow tubular spray arm to promote said vortex flow of water within said chambers.

* * * * *